United States Patent [19]

Bassi et al.

[11] Patent Number: 4,581,703

[45] Date of Patent: Apr. 8, 1986

[54] ELECTRONIC INJECTION CONTROL DEVICE FOR A MULTI-CYLINDER INTERNAL COMBUSTION ENGINE

[75] Inventors: Aldo Bassi, Milan; Giancarlo De Angelis, Bollate; Riccardo Mainardi, Milan; Renato Saglimbeni, Bollate; Dario Radaelli, Legnano, all of Italy

[73] Assignee: Alfa Romeo Auto S.p.A., Naples, Italy

[21] Appl. No.: 539,115

[22] Filed: Oct. 5, 1983

[30] Foreign Application Priority Data

Oct. 29, 1982 [IT] Italy ..... 24008 A/82

[51] Int. Cl.[4] ..... F02M 51/00

[52] U.S. Cl. ..... 364/431.05; 123/480

[58] Field of Search ..... 364/431.05, 431.04, 364/431.07; 123/480, 486, 500

[56] References Cited

U.S. PATENT DOCUMENTS 4,257,377 3/1981 Kinugawa et al. ..... 123/480
4,354,239 10/1982 Kanegae ..... 123/486
4,438,496 3/1984 Ohie ..... 364/431.05
4,471,743 9/1984 Watanabe ..... 123/480

FOREIGN PATENT DOCUMENTS 0096339 7/1980 Japan ..... 123/486

*Primary Examiner*—Parshotam S. Lall
*Attorney, Agent, or Firm*—Charles E. Brown; Charles A. Brown

[57] ABSTRACT

The invention relates to an injection control device for an internal combustion engine, in which a programmed microprocessor calculates the open time of a plurality of electrically operated injectors as a function of prechosen engine parameters, and determines the activation of said injectors into their open state and their deactivation into their closed state with the aid of a single timer, which counts-out the calculated open time. If a second injector is opened while a first injector is still delivering the fuel, the microprocessor calculates the difference between the open time of the second injector and the remaining open time of the first injector, so as to be able to count-out the open time of the two injectors on the single timer.

3 Claims, 2 Drawing Figures

Fig.2

COUNTING BY TIMER 56 OF OPENING TIME Ti OF THREE INJECTORS [(1),(2),(3)] SIMULT. OPENED, WITH DIFF. $\Delta Ti_2$ AND $\Delta Ti_3 > 0$

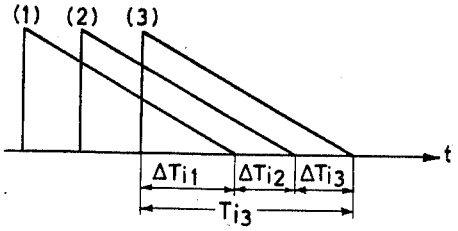

IF DIFF. $\Delta Ti_3 < 0$

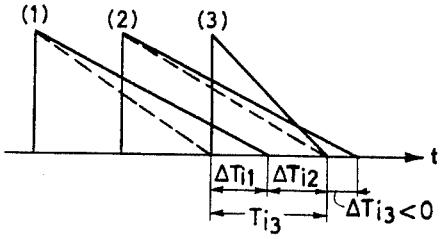

ROUTINE OF CLOSING INJECTORS AND POSSIBLE LOADING OF TIMER 56 (INTERRUPT. SIGNAL FROM TIMER AT THE END OF COUNTING OPENING TIME)

ROUTINE OF OPENING INJECTOR (3) (LOADING OF TIMER 56, COUNTING OF POSSIBLE $\Delta Ti_3$ AT THE ARRIVING OF INTERRUPT. SIGNAL CAUSED BY IMPULSE SIGNAL OF SENSOR 33)

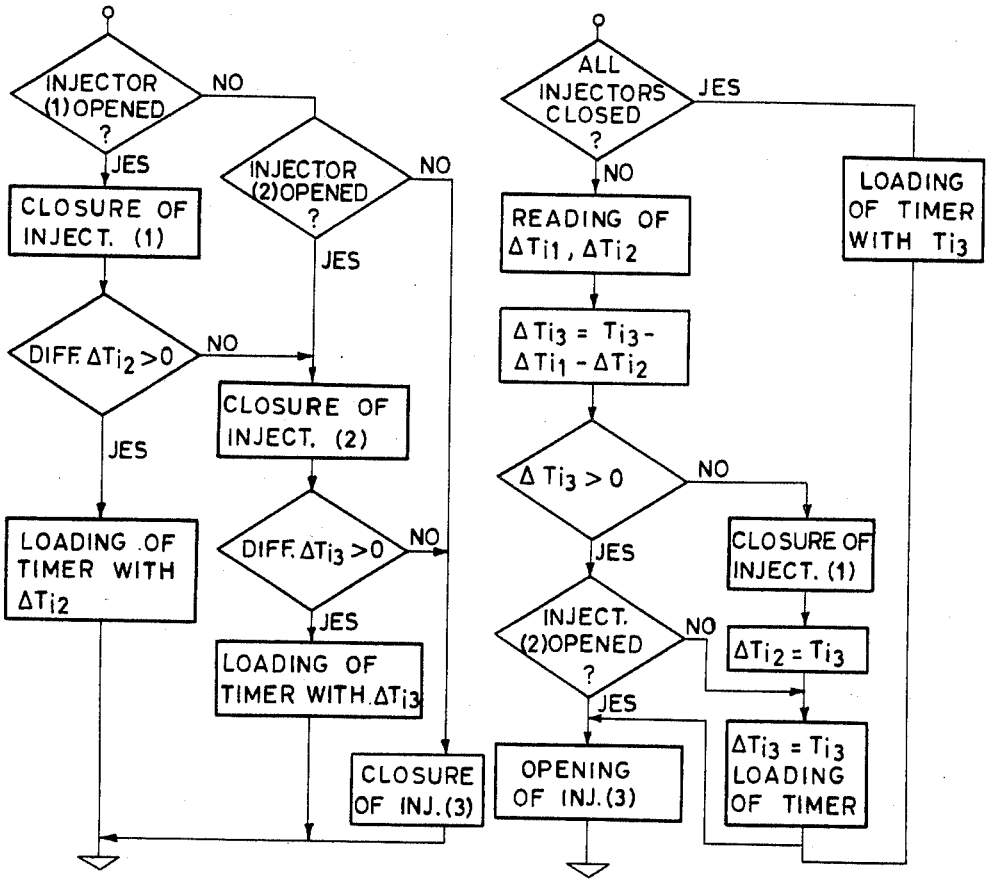

ELECTRONIC INJECTION CONTROL DEVICE FOR A MULTI-CYLINDER INTERNAL COMBUSTION ENGINE

This invention relates to an electronic microprocessor device for controlling the injection of a multi-cylinder internal combustion engine provided with a plurality of electrically operated injectors, in which the microprocessor effects the operations involved in calculating the injection time and in determining the activation and deactivation of the injectors.

Devices of this kind are becoming increasingly developed for controlling motor vehicle engines because in addition to considerable operational versatility they possess high reliability and constant behaviour with time, and their cost is increasingly reducing. These devices are able to satisfy the often opposing requirements of internal combustion engine control systems, to obtain very satisfactory results in terms of elimination of the pollutants present in the exhaust gas and reduction in fuel consumption, together with good performance in terms of operational versatility and engine delivered power.

The current tendency is to construct microprocessors with largely integrated components, leading to a considerable concentration of functions in a minimum space. However, in constructing the control devices auxiliary units are also often necessary, which in themselves are of a certain overall size and require rather complicated circuits for connection to the microprocessor. By minimising the number of these auxiliary units, increasingly compact devices are constructed which are more easy to arrange, especially on motor vehicles, where space problems are often critical.

The object of the present invention is an electronic microprocessor device for controlling the injection of a multi-cylinder internal combustion engine provided with a plurality of electrically operated injectors which are activated in a determined operating sequence, wherein the operations involved in sequentially deactivating all the injectors are determined by the microprocessor with the support of a single auxiliary unit, namely a timer.

The device can thus also operate where a second injector is activated into its open state while a first injector is still delivering fuel, because the microprocessor calculates the difference between the open time of the second injector and the remainder of the open time of the first injector, and loads this difference on to the timer at the moment of closure of the first injector, so as to be able to determine the closure of the second injector when this difference has been counted out by the single timer. This solution based on the use of a single timer for controlling a plurality of injectors not only allows a reduction in the cost of the components used, but in particular leads to a large space saving in the construction of the device, because in connecting a timer to the microprocessor a large number of tracks have to be used which extend close to each other and are bulky and difficult to arrange.

An electronic device has therefore been provided for controlling the injection of a multi-cylinder internal combustion engine fitted with a plurality of electrically operated injectors and with at least one feed air throttle valve, comprising a programmed microprocessor (CPU), a random access memory (RAM), a read-only memory (ROM) containing the calculation programs for said microprocessor and the tables of necessary data for the calculation, and an input/output unit, which are connected together and to said microprocessor by parallel interconnection lines (bus lines) for the data, for the addresses and for the control signals, the input/output unit being operationally connected to sensors of prechosen engine parameters, to first pulse generator means arranged to provide a pulse signal for each fuel delivery to be effected in one revolution of the engine, to second pulse generator means arranged to provide a further pulse signal for each engine cycle, and to injector actuator means, the device also comprising timer means operationally connected to said microprocessor, said microprocessor being programmed:

- to calculate the open time of the injectors as a function of said engine parameters,
- to determine the activation of an injector into its open state on the arrival of the corresponding pulse signal originating from said first pulse generator means,
- to load said timer means with the calculated open time on the arrival to said pulse signal, and
- to determine the deactivation of said injector into its closed state on termination of the counting of the open time on said timer means, the device being characterised in that said timer means are constituted by a single timer, the microprocessor being programmed:

- to calculate, if a subsequent injector is activated into its open state while a preceding injector is still delivering fuel and the relative open time has been loaded on to said timer, the difference between the open time of the subsequent injector and the remainder of the opening time of the preceding injector,
- to evaluate if said difference is greater, less than or equal to zero,
- to load said timer with said difference, if this is greater than zero, at the moment of closure of the preceding injector, and
- to determine the deactivation of said subsequent injector into its closed state when said difference has been counted out on said timer;
- to interrupt the counting of said timer on attaining the open time reduced by said difference, if this is less than zero, and
- to determine, at the end of said counting, the simultaneous closure of said preceding and subsequent injectors;
- to determine, on termination of the counting of the open time of said preceding injector, the simultaneous closure of said preceding and subsequent injectors, if said difference is equal to zero.

The result is a considerably precise and reliable device both in its calculations and in its injector actuation determinations, including when two injectors operate together, even though a single timer is used as the auxiliary unit.

FIG. 2 is a flow diagram.

Figure 1:
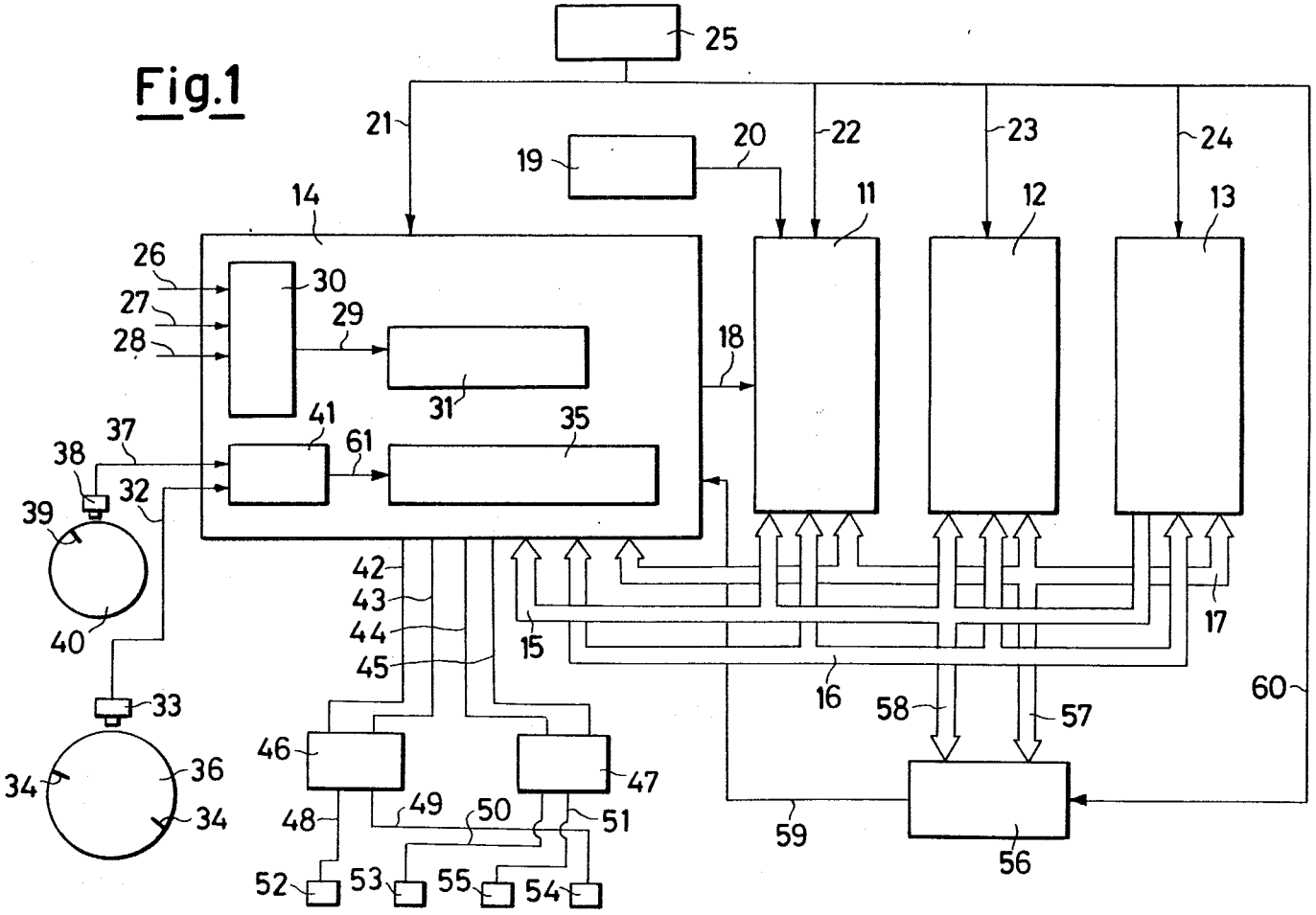
FIG. 1 is a block diagram showing the details of the invention.

Further details of the invention are given hereinafter with reference to FIG. 1 in which there is illustrated a preferred embodiment of said invention by way of non-limiting example. The device shown in the drawing is constituted by a microprocessor (CPU) 11, a random access memory (RAM) 12, a permament read-only memory (ROM) 13, which contains the data tables and the operating programs for the microprocessor, and an input/output unit 14. The microprocessor, memories and input/output unit are connected together by a parallel interconnection line (bus line) 15 for the data, by a parallel interconnection line 16 for the addresses, and by a parallel interconnection line 17 for the internal control signals.

The reference numeral 18 indicates a connection line between the input/output unit 14 and the microprocessor 11 for conveying the interruption signals. These interruption signals serve for interrupting the calculation programs under way in the microprocessor when determined events occur.

The reference numeral 19 indicates a clock pulse generator able to provide the microprocessor 11 with a train of pulses of determined frequency through the line 20.

The reference numerals 21, 22, 23, 24 indicate lines which connect the units 14, 11, 12, 13 to a power supply unit of stabilised voltage, represented by the block 25.

The input/output unit 14 receives through the line 26 a signal emitted by a sensor which senses the angular position of the engine feed air throttle valve; it also receives through the line 27 a signal emitted by a sensor which senses the engine cooling water temperature; it further receives through the line 28 a signal emitted by a sensor which senses the engine feed air temperature. These signals reach a multiplexer indicated by 30, which feeds them, as required by the microprocessor, through the internal line 29 to an analog/digital conversion circuit 31.

The input/output unit also receives, through the line 32, a pulse signal generated by the magnetic sensor 33 on passage of the notches 34 of the wheel 36, which is connected to the drive shaft.

In the case under examination, the injection control device is applied to a four cylinder four-stroke engine, in which two injectors have to be activated into their open position for each revolution of the engine. Consequently the wheel 36, which can be the engine flywheel, is provided with two notches 34 disposed 180° apart and suitably offset relative to the cylinder top dead center. When these two notches pass in front of the sensor 33, they generate two reference pulses for each engine revolution, each of which is used by the microprocessor for activating into its open position the injector associated with the cylinder which is about to effect its intake phase. The unit 14 receives through the line 37 a second pulse signal emitted by the magnetic sensor 38 on passage of the notch 39 of the wheel 40, which is connected to a shaft rotating at one half the speed of the engine. The notch 39 is suitably offset from the cylinder top dead center, and the pulse signal which it generates at every two revolutions of the engine serves for counting the engine cycles as the engine is of the four-stroke type.

The pulse signals carried by the lines 32 and 37 enter an adaptation circuit 41 where they are squared and fed through the internal line 61 to a counter register 35 and, in the form of interruption signals, to the microprocessor 11.

The input/output unit 14 is connected by the lines 42, 43, 44, 45 to the final power stages 46 and 47, which control the two pairs of injectors 52, 53 and 54, 55 by way of the conductors 48, 49, 50 and 51.

The final power stages are completely conventional, and comprise power transistors connected to the electricity supply and to the injector energising coils.

The reference numeral 56 indicates a decremental timer connected to the central microprocessor unit 11 by way of the parallel interconnection lines 57 and 58, and having its interruption signals conveyed through the line 59. The timer 56 is also connected to the power supply unit 25 by means of the line 60. The microprocessor 11 executes the calculation programs, and uses the tables of data contained in the permanent memory 13 for processing the signals indicative of the engine operating conditions which enter the multiplexer 30, and for processing the pulse signals originating from the magnetic sensor 33 in order to obtain the engine rotational speed (for example in accordance with the method described in Italian patent application No. 24076 A/79 of the same applicant), and further for calculating the injector open time $T_i$ of the injectors 52–55 as a function of the engine parameter values. The microprocessor 11 is programmed to update the calculation of the injector open time $T_i$ twice for each engine revolution, the calculation frequency being commensurate with the fuel delivery frequency, whereas in the case of a six cylinder engine, for example, the calculation would have to be updated three times for each engine revolution.

On arrival of a pulse signal from the sensor 33, the input/output unit 14 feeds the microprocessor with an interruption signal through the line 18. The microprocessor then identifies the injector to be activated by reading the counter register 35, as each pulse is associated with an injector 52–55, and feeds a control signal to the relative power stage (46 or 47) for activating the same injector into its open state.

The control signal emitted by the microprocessor is converted in the power stage (46 or 47) into a signal suitable for causing energisation of the injector coil in accordance with the required pattern. For example, said signal can comprise a current peak for accelerating the opening, followed by a step of reduced amplitude for maintaining said injector open.

While it feeds the opening control signal to the injector, the microprocessor loads the timer 56, through the line 58, with the numerical value representing the calculated open time $T_i$, and commands the timer to count it out. At the end of the count, the timer feeds the microprocessor, through the line 59, with an interruption signal which is used for determining the deactivation of the respective injector into its closed state.

If it happens that while a first injector (for example 52) is in its delivery stage the microprocessor receives a pulse signal generated by the notch 34 associated with a subsequent injector in the delivery sequence (for example 53), the microprocessor determines the opening of this second injector (53), and simultaneously, by reading the state of the count which the timer 56 has reached at the instant of opening of the second injector (53), it calculates the remainder $\Delta T_{i1}$ of the open time of the first injector (52). This remainder is subtracted from the open time $T_{i2}$ of the second injector, also calculated by the microprocessor, to obtain a time difference $\Delta T_{i2} = T_{i2} - \Delta T_{i1}$.

This difference $\Delta T_{i2}$ can be greater, less than or equal to zero, for example if the engine is accelerating, decelerating or running at constant load.

In the first case, ie $\Delta T_{i2}$ is greater than 0, at the instant of closure of the first injector 52 due to the count down of the timer 56, the calculated difference $\Delta T_{i2}$ is loaded on to the timer 56 to be counted out. At the end of the mean count, said timer 56 feeds the microprocessor with an interruption signal, which is used in order to deactivate the second injector (53) into its closed state.

In contrast, if said difference $\Delta T_{i2}$ is less than zero, the microprocessor interrupts the count of the timer 56 when this reaches the counting state in which the remainder of the open time of the first injector is equal to said difference $\Delta T_{i2}$. At this point, the microprocessor causes the first and second injector to close simultaneously, and zeroes the timer.

Again, if said difference $\Delta T_{i2}$ is equal to zero, on termination of the counting of the open time $T_{i1}$ loaded on to the timer 56, the microprocessor causes the first and second injectors to close simultaneously.

In the case of an engine with more than four cylinders, for example six, it can happen that while a first and second injector are in their delivery stage, a third injector is activated into its open state. In this case, the microprocessor, by reading the counting state reached by the timer 56 at the instant of opening of the third injector, calculates the remainder $\Delta T_{i1}$ of the open time of the first injector. This remainder is added to the difference $\Delta T_{i2}$ calculated for the second injector, and the result is subtracted from the calculated open time $T_{i3}$ of the third injector, to obtain a further time difference. $\Delta T_{i3}=T_{i3}-\Delta T_{i2}-\Delta T_{i1}$.

If this difference $\Delta T_{i3}$ is greater than zero, at the instant of closure of the second injector it is loaded on to the timer 56 in order to be counted out, and at the end of the count the microprocessor causes the third injector to close.

In contrast, if said difference is less than zero, the microprocessor immediately causes the first injector to close, zeroes the timer 56 and reloads it with the open time of the third injector. When the timer terminates this count, the microprocessor causes the second and third injector to close simultaneously.

In the case of rapid engine acceleration, which is sensed by the microprocessor when the angle of opening of the throttle valve exceeds a given value in a predetermined time interval, for example if $\Delta\alpha > 3.5°$ in the time taken for the drive shaft to turn through 180°, the microprocessor calculates an increased value for the injector open time by using the data contained in a suitable table in the memory 13.

This increased value is loaded on to the timer 56 and is used for opening the injector associated with the cylinder which is about to effect its intake stage, and also simultaneously for opening the injector of the cylinder which immediately precedes it in the combustion sequence.

A greater quantity of fuel is thus injected, as required by the greater quantity of air drawn in by the engine due to the rapid opening of the throttle valve, and the mixture ratio is maintained within the values appropriate for correct combustion.

The flow diagram of FIG. 2 is self-explanatory.

By way of example, the symbols of the components used for constructing the device according to the invention are as follows:

| | |
|---|---|
| Microprocessor 11 | SGSZ80 |
| ROM memory 13 | M36.000-5B1AS |
| RAM memory 12 | 2114 |
| Timer 56 | CTCZ80 |

We claim:

1. An electronic device for controlling the injection of fuel into a multi-cylinder internal combustion engine fitted with a plurality of electrically operated fuel injectors operable in a determined operating sequence, and with at least one feed air throttle valve, said electronic device comprising a programmed microprocessor (CPU), a random access memory (RAM), a read-only memory (ROM) containing the calculation programs for said microprocessor and the tables of necessary data for the calculation, and an input/output unit; said random access memory, said read-only memory, and said input/output unit being connected together and to said microprocessor by parallel interconnection lines (bus lines) for the data, for addresses and for control signals; said input/output unit being operationally connected to sensors of prechosen engine parameters, to first pulse generator means arranged to provide a pulse signal for each fuel delivery to be effected in one revolution of the engine, to second pulse generator means arranged to provide a further pulse signal for each engine cycle, and to injector actuator means; said device also comprising timer means operationally connected to said microprocessor, said microprocessor being programmed:

to calculate the open time of the injectors as a function of said engine parameters, to determine the activation of an injector into its open state to commence fuel injection on the arrival of a corresponding pulse signal originating from said first pulse generator means, to load said timer means with the calculated open time on the arrival of said corresponding pulse signal, and to determine the deactivation of said injector into its closed state on termination of the counting of the open time on said timer means, the device being characterised in that said timer means are constituted by a single timer, the microprocessor being programmed:

to calculate, in the event of a second injector being activated into its open state while a first injector is still delivering fuel and the relative open time has been loaded on to said timer, the difference between the open time of the second injector and the remainder of the open time of the first injector, to evaluate if said difference is greater, less than or equal to zero, to load said timer with said difference, if this is greater than zero, at the moment of closure of the first injector due to the termination of the counting time set on the timer for the first injector, and to determine the deactivation of said second injector into its closed state when said difference has been counted out on said timer;

to interrupt the counting of said timer on attaining the open time reduced by said difference, if said difference is less than zero, and to effect, on termination of said counting, the simultaneous closure of said first and second injectors;

to effect, on termination of the counting of the open time of said first injector, the simultaneous closure of said first and second injectors, if said difference is equal to zero.

2. A device as claimed in claim 1, characterised in that said microprocessor is programmed:

to calculate, in the event of a third injector being activated into its open state while said first and second injectors are still delivering fuel and the open time of the first injector has been loaded on to said timer, the further difference between the open time of the third injector and the sum of the remaining open time of the first injector and the calculated open time difference for the second injector, to evaluate if said difference is greater than, less than or equal to zero, to load said timer with said further difference, if this is greater than zero, at the instant of closure of the second injector, and to determine the deactivation of said third injector into its closed state on termination of the counting of said further difference on said timer;

if said further difference is less than zero, to immediately determine the deactivation of said first injector into its closed state and the zeroing of said timer, and to load said timer with the open time of said third injector at the instant of closure of the first injector, and to determine the deactivation of said second and third injectors into their closed state on termination of the counting of the open time of said third injector.

3. A device as claimed in claim 1, characterised in that said microprocessor is programmed:

to evaluate if the angle of opening of the throttle valve increases by more than a given value in a predetermined time interval, to calculate an increased open time for the injectors on the basis of the data contained in said read-only memory (ROM), to determine the activation into its open state of a second injector associated with the cylinder about to effect the intake stage, and simultaneously the activation into its open state of the immediately preceding first injector in the operating sequence on the arrival of the pulse signal relative to said second injector, to load said timer with the increased open time on the arrival of said pulse signal relative to said second injector, and to determine the deactivation of said two injectors into their closed state on termination of the counting of the increased open time on said timer.

* * * * *